72-469

10/15/85 CH 4,546,639

United States Patent [19]

Corrette

[11] Patent Number: 4,546,639

[45] Date of Patent: Oct. 15, 1985

[54] THREAD ROLLING DIES FOR FORMING SELF TAPPING SCREWS AND THE LIKE

[75] Inventor: Richard H. Corrette, Cleveland, Ohio

[73] Assignee: Colt Industries Operating Corp, Cleveland, Ohio

[21] Appl. No.: 535,796

[22] Filed: Sep. 26, 1983

[51] Int. Cl.[4] ..... B21H 3/06

[52] U.S. Cl. ..... 72/469; 72/88

[58] Field of Search ..... 72/469, 88, 90, 71, 72/103; 10/4, 9, 152 R

[56] References Cited

U.S. PATENT DOCUMENTS

| | | | |
|---|---|---|---|
| 375,098 | 12/1887 | Rogers | 72/469 |
| 2,284,659 | 6/1942 | Hosking | 72/88 |
| 3,195,156 | 7/1965 | Phipard, Jr. | 10/10 R |
| 3,204,442 | 9/1965 | Wieber | 72/88 |
| 3,426,642 | 1/1969 | Phipard, Jr. | 10/10 R |
| 3,452,375 | 7/1969 | Gabbey | 72/88 |
| 3,685,328 | 8/1972 | Carpenter et al. | 72/469 |
| 3,831,415 | 8/1974 | Skierski | 72/469 |
| 3,835,694 | 9/1974 | Skierski | 72/469 |
| 4,235,149 | 11/1980 | Veldman | 10/10 R |
| 4,315,340 | 2/1982 | Veldman | 10/10 R |

FOREIGN PATENT DOCUMENTS

| | | | |
|---|---|---|---|
| 2045133 | 10/1980 | United Kingdom | 72/469 |

*Primary Examiner*—Daniel C. Crane

*Attorney, Agent, or Firm*—Pearne, Gordon, Sessions, McCoy, Granger & Tilberry

[57] ABSTRACT

A method and apparatus for forming self tapping threaded fasteners having a cylindrical gripping portion and a tapered end portion with swaging lobes thereon is disclosed. The apparatus includes a pair of flat dies having a flat G-surface formed with thread rolling grooves therein to form the gripping cylindrical portion of the fastener. A rise angle surface having thread forming grooves therein with lobe forming recesses adjacent to the finished end operate to form the tapered point with lobes thereon. The G-surface is wider at the forward end of the die and progressively narrows until a dwell or finished portion is reached adjacent to the finish end of the die. Consequently, the threads along the tapered portion of the blank are not as fully formed as the threads along the cylindrical portion when the blank reaches the finishing end and excess material is available to fill the recesses and produce the lobes.

4 Claims, 9 Drawing Figures

THREAD ROLLING DIES FOR FORMING SELF TAPPING SCREWS AND THE LIKE

BACKGROUND OF THE INVENTION

This invention relates generally to a novel and improved method of rolling threads on a self tapping fastener and to a novel and improved dies for performing such method.

PRIOR ART

Self tapping or thread forming fasteners which form a thread as they are driven into an opening are well known. Very often such fasteners are formed with a tapered end portion having tapered threads thereon which swage internal threads around the opening into which the fastener is threaded. Behind the tapered ends such fasteners usually provide a uniform diameter gripping portion which engages the threads formed by the tapered portion.

In order to reduce the driving torque required to swage the threads, some such fasteners are formed with radially projecting lobes along the tapered threads on the tapered end portion of the fastener. Examples of such fasteners or screws are illustrated in the U.S. Pat. Nos. 3,195,156; 3,426,642; 3,831,415; 3,835,694; 4,315,340 and 4,235,149.

The thread rolling dies for producing such fasteners or screws usually employ a flat surface for rolling the cylindrical or gripping surfaces of the fastener (such flat surfaces referred to herein as the G-surface), and a flat inclined surface (referred to herein as the rise angle surface) which rolls the threads on the tapered point. The intersection between the G-surface and the rise angle surface (referred to herein as the G-line) is parallel to the side edge of the dies along which the head of the fastener moves and the G-surface is of uniform width throughout its length.

When such dies are arranged to produce fastener having swaging lobes on the tapered end, the rise angle surface is formed with depressions or recesses adjacent to the finish end of the dies and the blank material is forced into such depressions to form the peripherally spaced lobes.

With such prior art dies, difficulty is oftened encountered in producing well defined lobes. In order to fill out the lobes it has often been necessary to tip the dies in to close up the rise angle surface at the finish end of the dies. By closing up the dies in this way it has been possible in most instances to create enough pressure in the blank to cause the blank material to flow into the lobe forming recesses. However, closing up the dies has usually caused excessive pressure on the dies which tends to cause the thread forming grooves along the dies, adjacent to the G-line at the finish end of the dies, to wear excessively and to often chip out causing premature die failure.

It is believed that with such prior art dies, this premature failure occurs because the threads on the tapered end are virtually fully formed by the time the blanks reach the lobe forming recesses and there is no excess material left to produce the lobes. Therefore dies have had to be closed up excessively to produce sufficient pressure to produce the required lobes.

SUMMARY OF THE INVENTION

In accordance with the present invention improved dies are provided to form self tapping screws having cylindrical gripping portions and threaded tapered ends having radially projecting lobes at peripherally spaced locations along the tapered threads. The dies are formed so that the formation of the threads along the tapered end portion of the blank is delayed so that when the blank reaches the finishing or dwell portion of the dies the threads along the tapered end are only partially formed and sufficient excess material is present to flow into the lobe forming recesses without requiring excessive pressures on the dies. Therefore, the dies produce well defined lobes without requiring that dies be closed up excessively.

In the illustrated embodiment the dies are formed with a G-surface which is wider at the forward or entrance end of the dies and progressively narrows until a dwell or finished portion of the dies is reached. This causes the G-line to be angulated toward the face edge of the dies along which the fastener head moves until the finished end of the dies are approached.

At the finished end the G-surface is uniform in width and the G-line is parallel to the face edge of the dies. Because the G-line is angulated toward the face edge of the dies along a first portion of the die, the rise angle surface is also angulated toward the face edge of the dies along such first portion.

As the blank enters the forward end of the dies little or no contact is provided between the tapered end of the blank and the rise angle surface. However, as the blank rolls along the dies the G-line moves progressively toward the intersection between the cylindrical portion of the blank and its tapered end portion until the G-line in effect reaches such an intersection at the beginning of the finishing or dwell portion of the dies.

Because the first portion of the rise angle surface is spaced away from the the tapered end portion of the blank and is angulated toward such end portion, the forming of the threads on the tapered end portion is delayed and at the time the blank reaches the finish or dwell end of the dies the threads along the tapered end portion are only partially formed. Therefore, excess material is present. The dwell or finish portion of the rise angle surface of the dies is formed with recesses into which the excess material flows relatively easily as the threads on the tapered end portion of the blank are finished. Therefore, fully formed lobes are produced without excessive closing up of the dies and excessive pressures on the dies are eliminated.

Tests performed on dies in accordance with the present invention have demonstrated that the die life is vastly improved. For example, such dies have been capable of producing an excess of 700,000 screws whereas comparable prior art dies have generally been capable of producing only about 100,000 screws.

These and other aspects of this invention are illustrated in the accompanied drawings and are more fully described in the following specification.

DETAILED DESCRIPTION OF THE DRAWINGS

Figure 1:
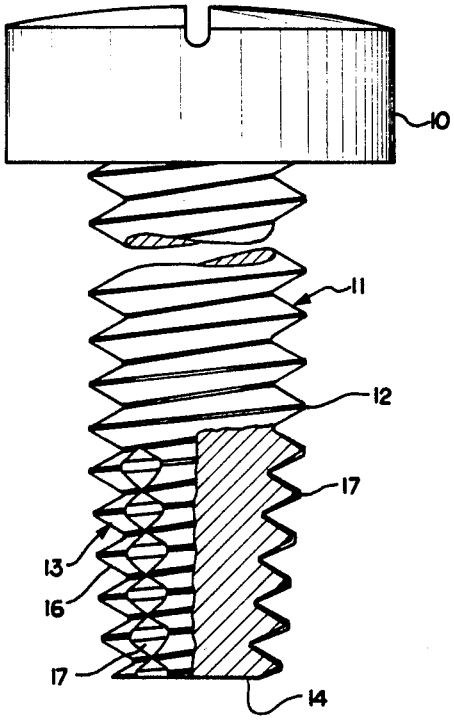
FIG. 1 is a fragmentary view partially in longitudinal section illustrating the tapered end portion of a fastener formed with swaging lobes and peripherally spaced locations along the threads of the tapered portion.
Figure 2:
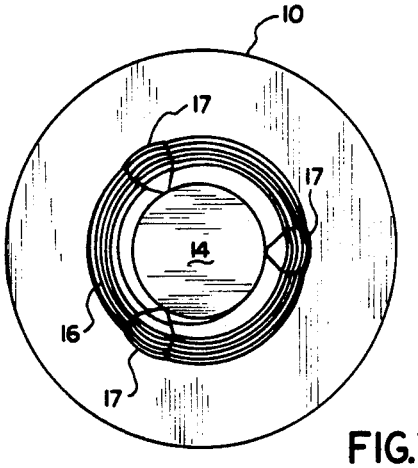
FIG. 2 is an end view of the fastener illustrated in FIG. 1.

FIGS. 1 and 2 illustrate the type of fastener or screw produced in accordance with the present invention. Such screw includes a head 10 of any suitable type, a cylindrical gripping portion 11 extends to the point 12 and beyond the point 12 the fastener is formed with a tapered end portion 13 extending from the point 12 to the end 14 of the fastener.

The threads along the cylindrical portion 11 are uniform convention threads. However, the threads 16 along the tapered end portion 13 in addition to being tapered are provided with arrays of lobes 17. Each array extends axially of the fastener and projects radially beyond the adjacent thread diameter so as to create a pressure concentration to swage the threads in a mating part as the fastener is threaded into such mating part. With such lobes the zones of high pressure are concentrated so as to produce the thread swaging operation without excessive torque. In the illustrated embodiment there are three arrays of lobes 17 peripherally spaced around the tapered end portion 13. Fasteners of this type are illustrated in the prior art patents listed above and form no part of this invention except to the extent that they can be manufactured more effectively in accordance with the method and apparatus of the present invention.

Figure 3:
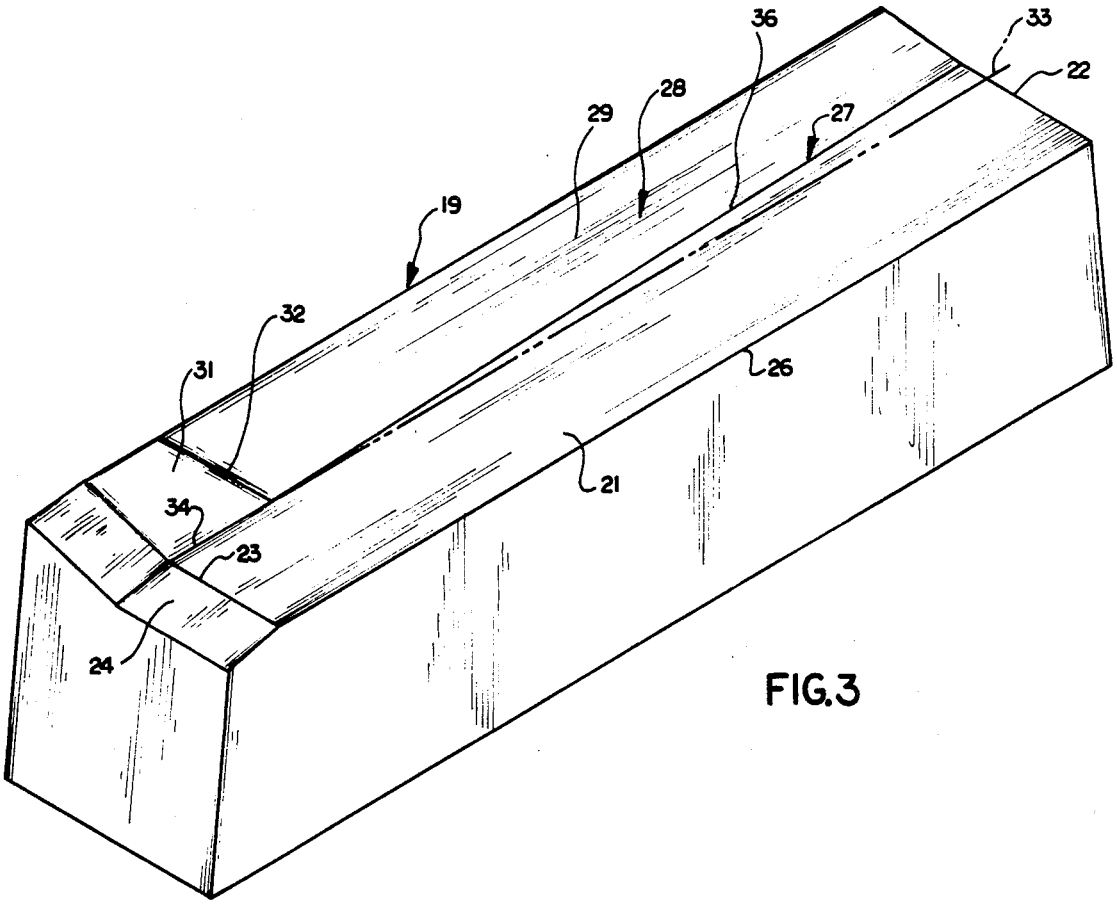
FIG. 3 is a perspective view of a die in accordance with the preferred embodiment of this invention illustrating the various surfaces thereof with the thread rolling grooves removed so that such surfaces can be clearly illustrated.

FIGS. 3 through 7 illustrate dies incorporating the present invention for producing fasteners of the type illustrated in FIGS. 1 and 2. In FIG. 3 thread forming grooves formed on the working faces of the dies have been eliminated so that the various die surfaces can be better illustrated. It should be understood however that finished dies of the type illustrated in FIG. 3 will be provided with thread forming grooves along the various working faces of the dies.

Figure 4:
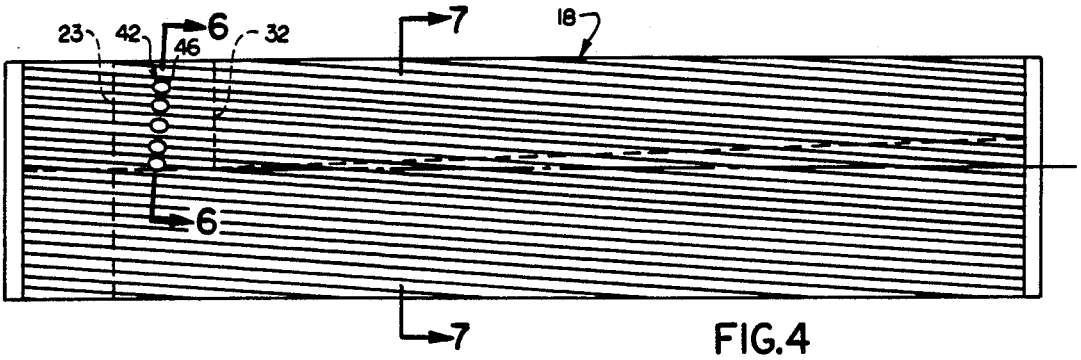
FIG. 4 is a side elevation of the long die of a pair of dies illustrating the thread rolling face thereof.
Figure 5:
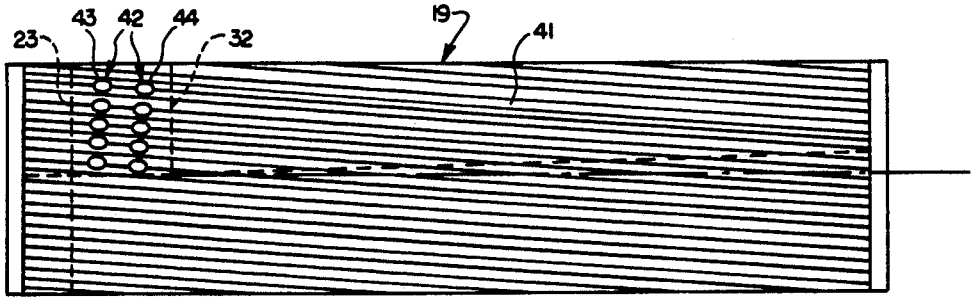
FIG. 5 is a side elevation of the short die of a pair of flat dies illustrating the thread rolling face thereof.

FIG. 4 illustrates the long die 18 of a pair of flat dies and FIG. 5 illustrates the short die 19 of a pair of flat dies incorporating the present invention. Except for the number and location of the recesses used to form the lobe 17 and for the difference in length of the dies, the two dies 18 and 19 have identical working faces. Therefore, the following description concerning the various working faces specifically referring to the short die illustrated in FIGS. 3 and 5 apply equally to the long die 18 illustrated in FIG. 4.

Referring specifically to FIG. 3 the die 19 is provided with a G-surface 21 extending from the forward or entrance end 22 of the die to the finish end at 23 where the G-surface 21 intersects a roll-off portion 24. Such G-surface extends laterally from a face edge 26 of the die along which the head 10 of the fastener rolls during the threading of the fastener to a G-line 27. The G-line 27 is located at the intersection of the G-surface 21 and an inclined rise angle surface 28.

The rise angle surface 28 includes a first planar portion 29 and a finish or dwell portion 31 which intersect along a line 32. The broken line 33 is an imaginary line extending parallel to the face edge 26 as a projection of the portion of the G-line 34 along the intersection between the G-surface and the dwell portion 31 of the rise angle surface. This line illustrates that the portion of the G-line 36 between the G-surface 21 and the first portion 29 of the rise angle surface 28 is inclined back from the line 31 as the G-line extends from the portion 34 to the forward end of the die at 22. In the illustrated embodiment the angle between the G-line and the line 33 is about 2°. Therefore, the G-surface 21 is wider at the forward end 22 of the die than at the finish end 23 and is progressively narrower as it extends toward the finish end to the intersection line 32. From the intersection line 32, however, the G-line is parallel to the face edge 26 and along such portion of the die the G-surface 21 has a uniform lateral width.

In my co-pending application Ser. No. 366,979 filed Apr. 9, 1982 self pointing cut-off dies having a variable G-surface width are disclosed. However, in that application the G-surface is progressively wider as it extends from the forward end toward the exit or finish end.

Figure 7:
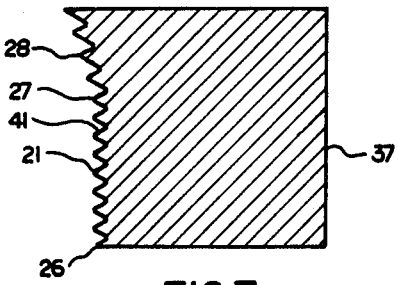
FIG. 7 is a cross section taken along 7—7 of FIG. 4 illustrating the cross sectional shape of the dies and the cross section of the thread forming grooves formed on the die.

As illustrated in FIG. 7 the G-surface 21 is parallel to the back surface 37 and the rise angle surface 28 is inclined upward from the G-surface at an angle which in the illustrated embodiment is 5°. Generally a 5° rise angle is used to roll blanks having a 7° tapered portion 13. However, other angles of rise angle and taper angle may be used.

Thread rolling grooves are formed throughout the length of the G-surface 21, the rise angle surface 28 and the roll-off surface 24. The purpose of the roll-off surface is to provide a surface along which the pressure of the dies on the blank is gradually relieved to prevent lines from being formed on the thread lengthwise of the fastener.

The thread rolling grooves 41 in the illustrated embodiment are arranged to produce a typical machine screw thread. However, other thread forms may be utilized as desired.

Figure 6:
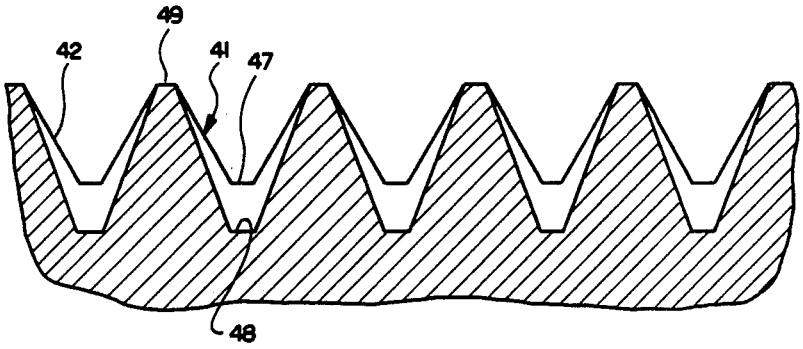
FIG. 6 is a greatly enlarged fragmentary section taken along 6—6 of FIG. 4 illustrating one set of lobe forming recesses formed in the dies.

Lobe forming recesses 42 best illustrated in FIGS. 4 through 6 are formed in the finished or dwell portion 31 of the rise angle surface 28. In the illustrated embodiment three arrays of recesses 42 are provided with two being located on the short die 19 and one located on the long die 18. The last array 43 is positioned a short distance from the end of the rise angle surface 28. Such arrays are arranged perpendicular to the thread forming grooves which in turn are inclined at the helix angle of the screw so that the recess of the array 43 closest to the G-line is slightly closer to the finished end 23 than the other recesses of such array when rolling right hand screws. The array 43 should be sufficiently close to the exit end 23 so that previously formed lobes are not reworked before the fastener roll off the exit end located along the line 23. Therefore the array 43 should be spaced from the exit end at 23 by a distance less than $\frac{1}{3}\pi$ times the rolling diameter of the thread being rolled. The short die 19 is also formed with a second array 44 which is spaced from the array 43 by a distance equal to $\frac{2}{3}$ of $\pi$ times the pitch diameter of the fastener.

The third array 46 formed on the long die 18 is spaced back from the exit end at 23 as distance equal to $\frac{1}{2}$ of the sum of the spacing between the exit end 23 and the two arrays 43 and 44.

Preferably the recesses 42 are shaped substantially as illustrated in FIG. 6 so that they extend down beyond the root at 47 of the threads grooves 41 to a maximum depth at 48. They are formed however with a steeper angle than the threads so that the crests 49 of the threads grooves 41 are not affected by the presence of the recesses 42. With such structure the roots of the threads on the fastener which are formed by the crests 49 are not affected by the presence of the lobes and the lobes extend from the roots of the threads of the fastener out beyond the crests of the threads on the fastener which are formed by the roots 47 of the grooves on the thread rolling dies.

For purposes discussed in greater detail below, the length of the dwell portion 31 of the rise angle surface should not exceed the length which will cause about two revolutions of the fastener and should exceed the length required to produce one revolution of the screw. Therefore the dwell length should be greater than $\pi$ times the rolling diameter and no greater than two $\pi$ times the rolling diameter.

Figure 8:
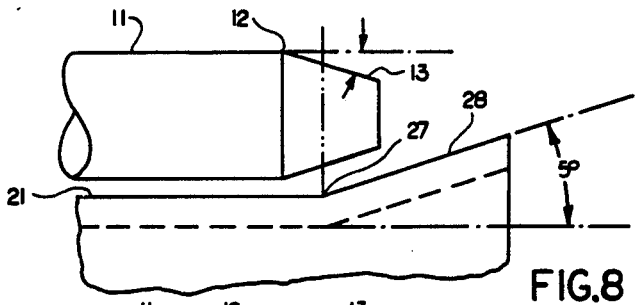
FIG. 8 is a schematic fragmentary view illustrating the position of the blank with respect to the rise angle surface at the forward or entrance of the die.
Figure 9:
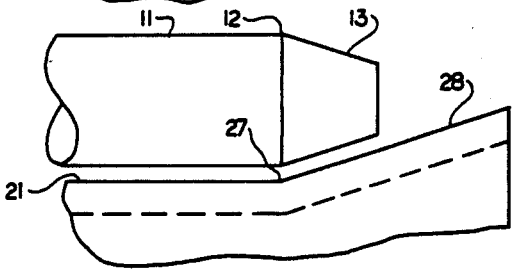
FIG. 9 is a schematic fragmentary view similar to FIG. 8 illustrating the relative position of the rise angle surface of the blank when the blank reaches the finish or dwell portion of the dies.

FIGS. 8 and 9 schematically illustrate the axial position of the blank with respect to the various surfaces as the blank rolls along the dies. It should be understood that the blanks although illustrated a space up from the die surfaces actually engage such surfaces and as the threads are formed on the blank project into the grooves formed in the working surfaces.

FIG. 8 represents the axially position of a blank with respect to the G-line 27 as the blank starts to roll along the working surfaces from the forward or entrance end of the dies. In such location the intersection at 12 between the cylindrical portion 11 and the tapered end portion 13 is located to the left (as viewed in FIG. 8) from the G-line 27. Therefore the cylindrical portion 11 is engaged in the normal manner with the G-surface 21. However, the tapered end 13 only lightly engages or does not engage the rise angle surface 28 at all. Therefore the degree of penetration of the thread forming grooves along the rise angle surfaces is not as great as the degree of the penetration of the thread forming grooves along the G-surface.

As the fastener blank rolls along the dies the G-line 27 tends to converge with the intersection 12 between the cylindrical portion 11 and the tapered portion 13 and by the time the blank reaches the intersection 32 between the two portions 29 of 31 of the rise angle surface, the G-line 27 is essentially in alignment with the intersection 12 as illustrated in FIG. 9. Consequently as the blank rolls along the dies the G-surface commences the formation of the threads along the cylindrical portion 11 of the fastener ahead of the formation of the threads on the tapered portion 13. At any given point along the dies along the portion 29 of the rise angle surface the threads along the tapered end 13 are not as fully formed as the threads along the cylindrical portion 11. The dies are set-up in the machine so that the entrance ends are spaced further apart than the finished ends so that the flat surfaces of the die progressively from the threads on the blank.

It should also be recognized that even though the thread forms are progressively formed they are progressively formed only that zone which actually engages the dies and the zones intermediate the engagement are formed only to the extent that engagement previously occur along such zones. Consequently when the blank reaches the intersection line at 22 between the portion 29 of the rise angle surface and the finished portion or dwell portion 31 of the rise angle surface the threads along the tapered portion are not as fully formed as the threads along the cylindrical portion. Therefore excess material is present along the tapered portion and at least some of such excess material flows into the recesses to form the lobes 17 without requiring excessive closing of the dies.

In effect the dies function in a manner in which the forming of the threads along the tapered portion is delayed compared to the forming of the threads along the cylindrical portion to provide excess material to flow into the recesses during the finishing of the blank at the exit end of the dies.

The dwell portion 31 of the rise angle surface should have a length which is sufficiently long to cause one revolution of the blank so that all surfaces of the tapered end are fully worked at the dwell portion 31. However the length of the dwell portion 31 should not exceed the length causing about two blank revolutions. If the dwell portion is too long the threads on tapered portion 13 become substantially fully formed before the recesses 46 are reached and the desired recess material is not available to fill the recesses.

Because of this invention it is been found that the excessive wear and chipping of the dies which has in the past occurred along the G-line at the exit end of the dies does not occur and that the dies incorporating the present invention and functioning in accordance with the method of the present invention are capable of rolling many more screws than the prior art dies which do not incorporate the present invention. As mentioned previously herein the improved output of the dies before they are worn out appears to be about seven times as much as the output of prior art dies and that better defined lobes are achieved in the screws that are produced. Further, the dies are easier to set up since it isn't necessary to tip the dies about their longitudinal axis to close up the rise angle surfaces.

Although the preferred embodiment of this invention has been shown and described, it should be understood that various modifications and rearrangements of the parts may be resorted to without departing from the scope of the invention as disclosed and claimed herein.

What is claimed is:

1. Thread rolling dies for threading blanks providing a cylindrical shank having a predetermined length and a tapered end portion of reducing diameter extending from one end of said cylindrical shank portion, comprising:

a pair of dies each providing a work face extending from a forward end to a finish end;

each work face providing a G-surface extending from said forward end to said finish end and a rise angle surface angulated up from said G-surface and intersecting said G-surface along a G-line extending lengthwise of said work face;

thread forming grooves formed lengthwise of said die along both of said G-surface and said rise angle surface providing grooves between crests;

said thread forming grooves along said G-surfaces operating to thread said cylindrical shank and said thread forming grooves along said rise angle surface operating to thread said tapered end portion;

said G-surface having a width at said forward end greater than said predetermined length and extending with progressively decreasing width toward said finish end; and longitudinally short recesses on said rise angle surface extending inwardly from the roots of said grooves into which material of said tapered end portion is pressed to form radially extending lobes on said tapered end portion which extend peripherally around said tapered end portion substantially less than one revolution, said recesses being spaced from said finish end by a distance no more than twice the rolling diameter of said cylindrical shank.

2. Thread rolling dies as set forth in claim 1 wherein said rise angle surface provides a first portion extending from said forward end toward said finish end, and a dwell portion extending from said first portion to said finish end, said G-surface having a uniform width along the length of said dwell portion, said first portion of said rise angle surface progressively forming threads on said tapered portion and said dwell portion finishing the threads thereon, said recesses being formed along said dwell portion.

3. Thread rolling dies as set forth in claim 2 wherein said dwell portions having a length at least equal to $\pi$ times the rolling diameter of said cylindrical portion of said blank and not substantially greater than two $\pi$ times said rolling diameter, said first portion of said rise angle surface leaving sufficient material in said tapered portion to substantially fill said depressions.

4. Thread rolling dies as set forth in claim 3 wherein said dies are flat dies, said G-surface and said first and dwell portions of said rise angle surface are planer surfaces with thread forming grooves therein.

* * * * *